US006457289B1

(12) United States Patent
Scherer

(10) Patent No.: US 6,457,289 B1
(45) Date of Patent: Oct. 1, 2002

(54) REINFORCEMENT FOR SURFACES OF STRUCTURAL ELEMENTS OR BUILDINGS

(76) Inventor: Josef Scherer, Alte Kantonsstrasse 16, Brunnen (CH), CH-6440

( * ) Notice: Subject to any disclaimer, the term of this patent is extended or adjusted under 35 U.S.C. 154(b) by 0 days.

(21) Appl. No.: 09/582,021

(22) PCT Filed: Dec. 20, 1998

(86) PCT No.: PCT/EP98/08352

§ 371 (c)(1),
(2), (4) Date: Nov. 22, 2000

(87) PCT Pub. No.: WO99/32738

PCT Pub. Date: Jul. 1, 1999

(30) Foreign Application Priority Data

Dec. 20, 1997 (DE) ..... 197 56 930

(51) Int. Cl.[7] ..... E04G 23/00

(52) U.S. Cl. ..... 52/514; 52/516; 52/251; 52/721.5; 264/36.1; 156/71

(58) Field of Search ..... 52/222, 223.6, 52/223.9, 251, 252, 514, 516, 721.5, 723.1, 723.2, 736.3, 736.4, 737.4, 737.5, 741.3; 264/36.1; 156/71, 166, 184

(56) References Cited

U.S. PATENT DOCUMENTS

| | | | | | |
|---|---|---|---|---|---|
| 4,259,127 | A | * | 3/1981 | Schachter | 156/71 |
| 4,489,176 | A | * | 12/1984 | Kluth et al. | 521/144 |
| 4,879,322 | A | * | 11/1989 | Markusch et al. | 523/322 |
| 5,043,033 | A | * | 8/1991 | Fyfe | 156/71 |
| 5,100,713 | A | * | 3/1992 | Homma et al. | 428/102 |
| 5,218,810 | A | * | 6/1993 | Isley, Jr. | 52/723.1 |
| 5,326,410 | A | * | 7/1994 | Boyles | 156/71 |
| 5,447,593 | A | * | 9/1995 | Tanaka et al. | 156/71 |
| 5,505,030 | A | * | 4/1996 | Michalcewiz et al. | 52/249 |
| 5,633,057 | A | * | 5/1997 | Fawley | 428/36.1 |
| 5,645,664 | A | * | 7/1997 | Clyne | 156/71 |
| 5,657,595 | A | * | 8/1997 | Fyfe et al. | 52/252 |
| 5,711,834 | A | * | 1/1998 | Saito | 156/153 |
| 5,924,262 | A | * | 7/1999 | Fawley | 52/721.4 |
| 6,189,286 | B1 | * | 2/2001 | Seible et al. | 52/721.4 |
| 6,330,776 | B1 | * | 12/2001 | Jinno et al. | 52/649.1 |

FOREIGN PATENT DOCUMENTS

| | | |
|---|---|---|
| GB | 2107371 | 10/1982 |
| GB | 2295637 | 5/1996 |
| WO | WO09701686 A1 | 1/1997 |
| WO | WO 97/21009 | 6/1997 |

* cited by examiner

*Primary Examiner*—Carl D. Friedman
*Assistant Examiner*—Brian E. Glessner
(74) *Attorney, Agent, or Firm*—Stevens, Davis, Miller & Mosher, LLP

(57) ABSTRACT

The invention relates to a reinforcement for surfaces of structural elements or buildings comprising at least one supporting layer (TS) optionally provided with a covering layer (DS), and an adhesive layer (KS) provided as a basis material (UG) for connecting the supporting layer to the structural element surface or to the building surface, said surface being optionally provided with a basis material primer. The aim of the invention is to produce a reinforcement or corresponding materials which permit a long-term escapement of moisture on the side of the basis material by preserving a solidity and rigidity sufficient for a broad range of applications, especially with regard to a reliable alleviation of load on the basis material with a corresponding transmission of tension to the reinforcement. The invention is characterized in that the hardened material of at least the adhesive layer (KS), optionally including a basis material primer (P), has at least one section-like steam, especially water steam, permeable structure which is associated with a high tensile strength and with exactly the same tensile elasticity module.

36 Claims, 3 Drawing Sheets

REINFORCEMENT FOR SURFACES OF STRUCTURAL ELEMENTS OR BUILDINGS

The invention relates to a reinforcement for surfaces of structural elements or buildings. The subject of the invention also includes corresponding structural elements and building components, as well as materials, a special polymer material in particular.

BACKGROUND OF INVENTION

Reinforcements are well known in the art in structural engineering. They are used to coat structural elements and building components, primarily ones of concrete, in particular for strengthening or repair purposes. As is known, use is made for this purpose of reinforcements applied by lamination or adhesion in situ or again of prefabricated and bonded reinforcements of fiber assemblies with bonding agents or adhesives, all of them of high or maximum strength and similarly high or maximum modulus of elasticity. The strengthening or repair requirement can be more or less optimally satisfied with such reinforcements. However, it has been found in practical operation that the moisture almost always present on the surface and in the interior of the base is detrimental to the long-term durability of the connection between reinforcement and base transmitting transverse strains and tensile stresses and even to the long-term durability of the coated concrete itself. No satisfactory solution has been found up to the present for the resulting problems of bond strength and durability.

SUMMARY OF INVENTION

The object of the invention is accordingly to develop a reinforcement or suitable materials which, while preserving strength and rigidity adequate for broad applications, especially as regards reliable relief of stress on the base by adequate transfer of stress to the reinforcement, permits long-term escape of moisture from the area of the base.

The basic concept of the invention is interactive application for reinforcement of bonding or adhesive layer materials which possess the combined characteristics of high tensile strength and high tensile modulus of elasticity in keeping with the purpose of bonding on the structural element or building component, along with vapor permeability determined by the durability requirement. A structure such as this is considered above all for layered reinforcements in which a fiber assembly is installed by aspiration of binder into the bonding layer applied to the base. The binder remaining on the base then simultaneously represents the adhesive layer. The vapor permeable binder provided as claimed for the invention accordingly allows outward diffusion of the moisture in the base. Then again, there are structures with prefabricated layered material consisting of a fiber assembly and binder which is fastened to the base by means of a vapor-permeable adhesive layer claimed for the invention. For the most part the laminated material binder is in this case also vapor-permeable in accordance with the invention, but in theory an application is also possible which involves a laminated material binder which is not or is very slightly vapor-permeable, an application in which the always essential vapor-permeable adhesive layer leads to admittedly slower long-term removal of moisture from the base, as a result of transverse diffusion in the edge areas of the base. Suitable configuration of the reinforcement can promote such diffusion. On the whole, then, the teaching claimed for the invention represents significant technical progress in structure reinforcement engineering.

In addition to any materials which are possibly already available as such or may be readily produced for a combined application in accordance with the invention, the use of adhesive layer or binder or primer or cover layer material based on polyurethane is another feature of the invention which has proved itself in practical application, especially for laminated fiber reinforcements in which the binder also constitutes the adhesive layer. Special polyurethanes claimed for the invention, which themselves are also new and have proved themselves in practical application are products of reaction of low molecular polyols which possess rigid chains of molecules which are at least partly linear, with aromatic or heterocyclic polyisocyanates. The data relating to values for reinforcement materials permit valid compromise optimization with respect to divergent or contrary tendencies in action of the parameters for vapor permeability, having a water vapor permeation resistance $uH_2O$ or a maximum of approximately 350 $m^{-1}$ or within the range of 500 to approximately 3000 $m^{-1}$, and strength or modulus of elasticity of the binder and adhesive layer material for broad application, having a tensile modulus of elasticity of a minimum of approximately 1000 N/nm2 or in the range of approximately 3000 $N/nm^2$ to 6000 $N.nm^2$.

Another embodiment of the invention for extreme areas of requirements set for strength or rigidity of the binder and adhesive layer material, especially in conjunction with the features in the associated claims, opens up ways of optimizing while preserving the vapor permeability required. The underlying concept is achievement of higher strength and rigidity values for the adhesive layer or base layer within a vapor-permeable reinforcement layer in which an especially high tensile stress or shear stress exists between reinforcement and base or even in the reinforcement itself, higher strength and rigidity values for the adhesive layer or base layer at the expense of vapor permeability, the intermediate areas being adequately dimensioned with high vapor permeability for moisture removal. This development greatly increases the area of application of the invention. Extension of reinforcement in the high-load areas over the entire thickness of the reinforcement, that is, not merely to the thickness of the adhesive layer, can be accomplished easily in layering in situ by suitable surface distribution of different binder materials on the base before installation of the fiber assembly. On the other hand, this alternative of the invention may always be applied also to prefabricated laminated materials by installation on the base sections of adhesive layer sections clearly delimited on the basis of difference in composition before the prefabricated laminated materials are installed. This applies in suitable applications even to use of prefabricated laminated materials of low or no vapor permeability, when adequate moisture removal may be achieved through edge and transverse diffusion, or if desired by resorting to suitable layered reinforcement configurations.

It is claimed for the invention that primarily epoxy-based polymer materials curing under damp conditions or on a damp base are to be considered as adhesives and/or binders in the case of the alternatives discussed above and other alternatives. The high moduli of elasticity of the epoxy polymers may be used in this way also in the process of removal of moisture from a structure.

BRIEF DESCRIPTION OF THE DRAWINGS

Other features and advantages, along with aspects of problems solved by the invention, are discussed with reference to the diagrammatic examples presented in the drawings, in which.

Figure 1:
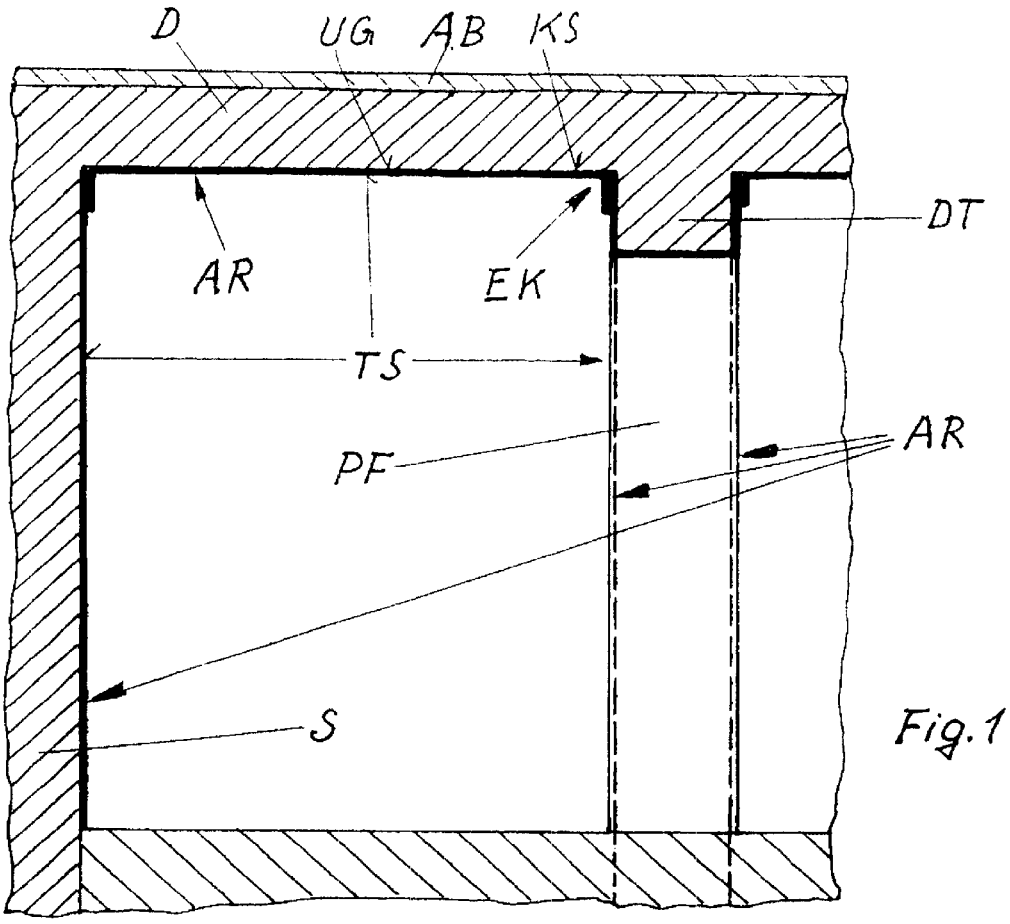
FIG. 1 illustrates a partial vertical section of a building component with roofed space and interior reinforcement.

The building element shown in FIG. 1 comprises an interior space with side wall S, and a column PF, ceiling D, and ceiling beam DT installed in it. All surfaces of this element are in the example provided with a surface-covering laminated material reinforcement AR which consists of a base layer TS with adhesive layer KS. The latter bonds the base layer to the concrete layer as base UG so as to resist shear and tensile stresses. In the corner areas EK the reinforcement is of overlapping design, such that an edge section of the reinforcement overlaps the re-entrant plane angle.

In the practical example the top of the ceiling D, more or less as a supporting outer surface, is provided as is customary with a load-bearing outer cover AB impermeable by moisture and vapor. A structural design such as this with surface covering reinforcement and in other respects with slight possibility of unimpeded discharge by diffusion illustrates the need for a vapor-permeable reinforcement provided as claimed for the invention.

Figure 2:
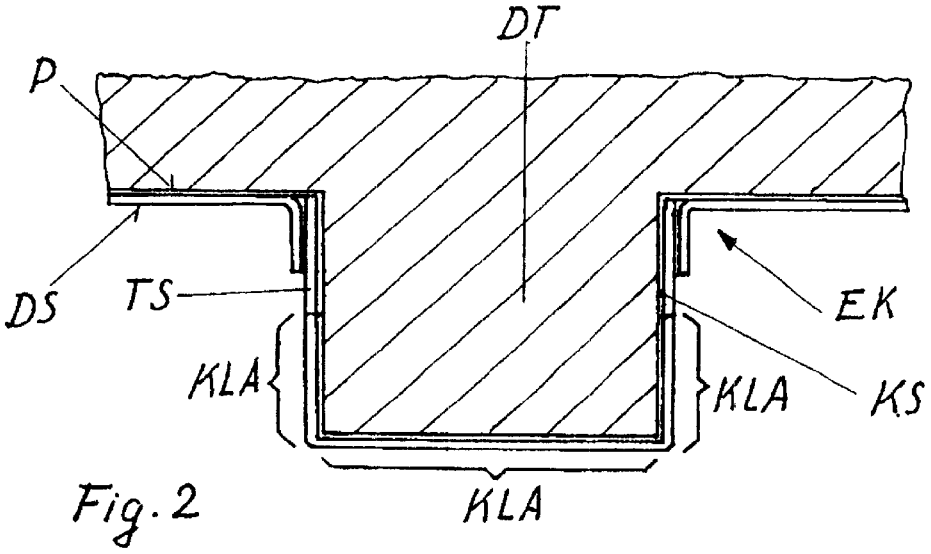
FIG. 2 illustrates a partial cross-section on a larger scale of a roof beam shown in FIG. 1.

The structure of the reinforcement with base layer TS and adhesive layer KS is illustrated in detail in FIG. 2. A primer layer P on the concrete surface and a cover layer DS on the exterior surface of the reinforcement are also shown. In addition to performing their own functions, these layers must also obviously meet the requirements of vapor permeability specified for the invention.

The ceiling beam DT is an example of a structural element subjected mostly to bending stresses. The corresponding tensile stresses, which are especially critical in the case of concrete, reach their maximum on the lower cross-sectional edge. Consequently, in the lower cross-sectional area it is chiefly high shear and tensile stresses, namely tensile separating stresses also acting perpendicular to the surface of the concrete, which must be transmitted through the adhesive layer KS from the concrete to the base layer TS. For such adhesive layer sections, designated KLA in FIG. 2, it is accordingly claimed for the invention that there is provided a material of increased strength and/or increased modulus of elasticity, but one of lower or no vapor permeability. The adjacent adhesive layer and base layer areas assume the moisture removal function in the concrete in this instance, in conjunction with the transverse diffusion potential normally present. The adhesive layer sections KLA extend in the longitudinal direction of the column, preferably to the ends of the column, and so also increase the ability to transmit concentrations of stress which may arise in the area of application.

Figure 3:
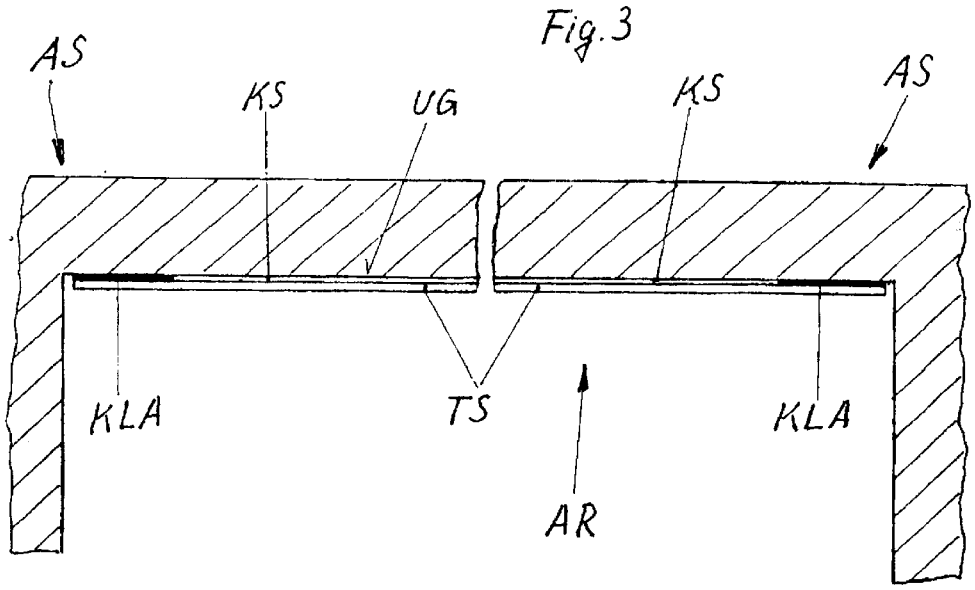
FIG. 3 illustrates a vertical section of a bridging element of a concrete structural element with a reinforcing element on the bottom.

Analogous layouts may also be considered for freestanding columnar building components. In this instance it is advantageous for the arrangement made to be such that the lamellar adhesive layer sections covered with material of higher strength and/or higher modulus of elasticity but of low or no vapor permeability at least over part of their length occupy, at least over part of their length, only part of the width of the longitudinal surface involved of the structural element or building element. This, again, is done for the sake of achieving an optimum compromise between reinforcement and moisture removal. FIG. 3 shows in this context a flat reinforcement AR on a ceiling surface subjected to bending stresses with wall connections AS on both sides acting as bearings. The case assumed here is that, because of the comparatively high vertical elasticity of the ceiling, possibly because of formation of cracks in the concrete, in the central area of the reinforcement for the most part only pressure forces are present between concrete and reinforcement and thus greater adhesive layer strength is not required there. Adhesive layer sections KLA of higher strength, above all shear strength, at the cost of lower vapor permeability, above all shear strength, and optionally of higher modulus of elasticity, are accordingly provided in the edge areas of the reinforcement. The situation thus corresponds more or less to that in a beam subject to bending to be reinforced in accordance with the invention and subjected to pressure while more or less free of restraint. The resulting advantage is a large diffusion surface in the central area of the reinforcement.

Experience has shown that the materials to be considered for adhesive layer sections of higher strength and/or higher modulus f of elasticity but of lower or no vapor permeability are preferably high-strength polymer adhesives, in particular epoxy or acrylate adhesives.

Figure 4:
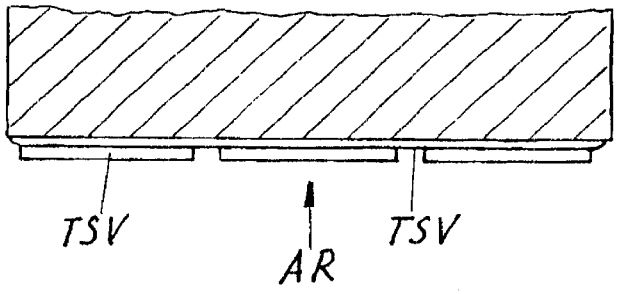
FIG. 4 illustrates a partial cross-section of a concrete beam with a reinforcing element on the bottom.

FIG. 4 illustrates a reinforcement AR on the bottom of a concrete girder subject to bending which is provided with a vapor-permeable adhesive layer KS and several base layers TSV mounted on opposite longitudinal edges, layers which are in the form of prefabricated flat material elements, especially laminated fiber materials. Because of the positioning of these elongated flat material elements with sufficient spacing between opposite longitudinal edges and suitable moisture removal due to the vapor-permeable adhesive layer KS, along with transverse diffusion in the concrete as well, prefabricated flat material elements may be employed in this instance, in particular as laminated fiber materials, with binders of higher strength and/or higher modulus of elasticity but of lower or no vapor permeability.

Figure 5:
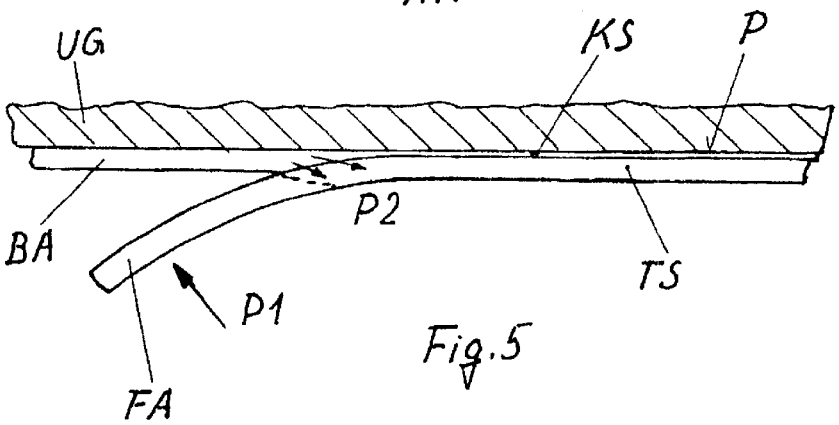
FIG. 5 illustrates a partial longitudinal section of a reinforcement in the layering stage.

FIG. 5 illustrates the structure and production of a reinforcement AR layered in situ. On the base UG provided with primer P there is a viscous base coat BA whose thickness is adapted to the total volume of the adhesive layer KS and filler volume of an area fiber assembly FA of the subsequent base layer TS. The fiber assembly FA is installed progressively, for example, is rolled on, in the direction of arrow P1, the binder filling the filler volume of the fiber layout in the direction of arrow P2. This results in a finished areal reinforcement. Customarily fiber clusters are considered for the fiber layout which have more or less juxtaposed support fibers, as well as fiber netting or plaited fibers, glass fibers in particular, and above all alkali-resistant E and/or AR glass fibers, carbon fibers, boron fibers, and/or high-strength polymer fibers, in particular aramide fibers.

Figure 6:
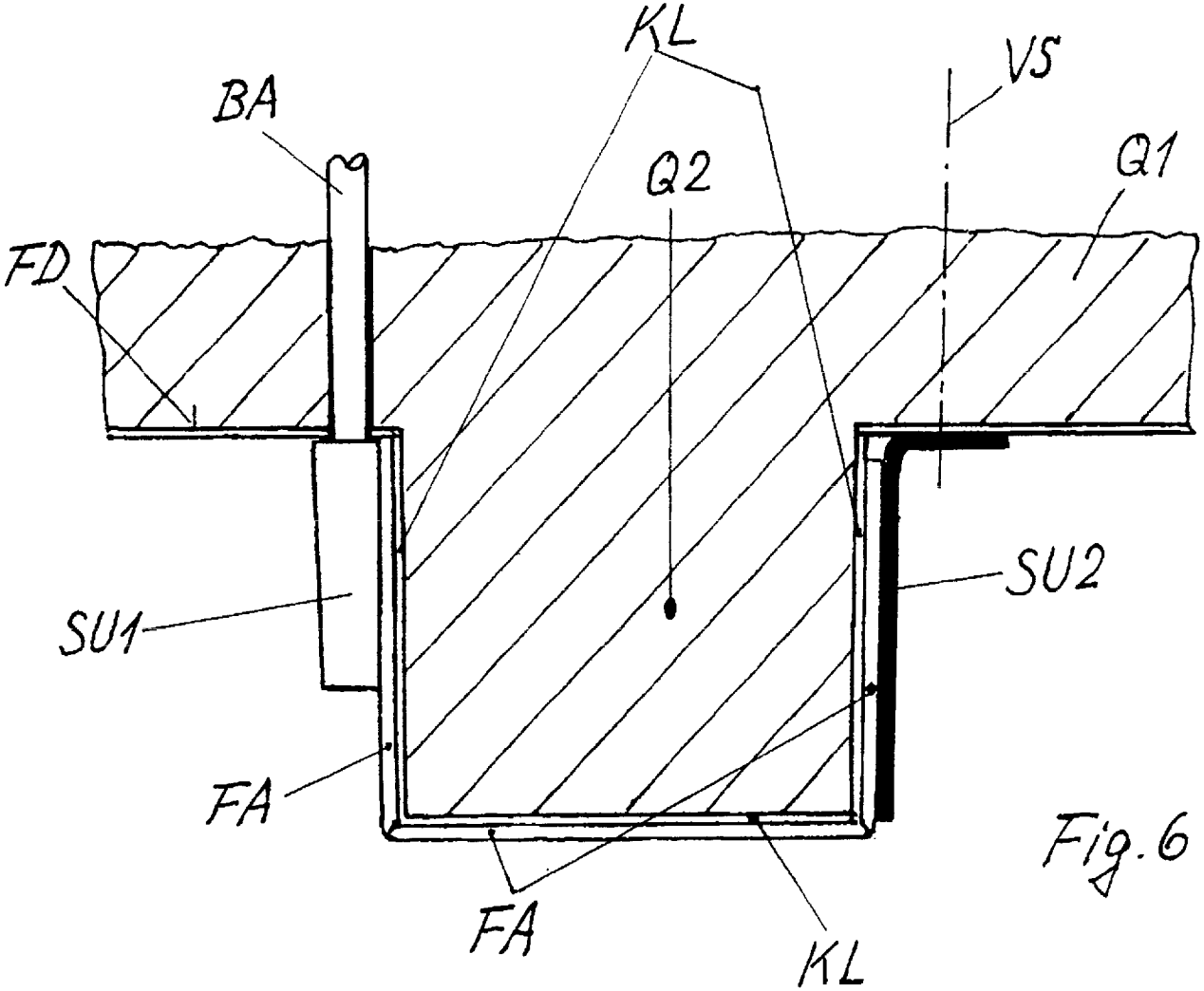
FIG. 6 illustrates a partial cross-section of a building with reinforcement as claimed for the invention and two different exemplary embodiments of a layout for shear stress transmission.

The portion of a building element shown in FIG. 6 may consist entirely of concrete provided with tensile reinforcements and may have its entire bottom surface or optionally only certain areas of it provided with a vapor-permeable fiber reinforcement FD, in particular with one having a polyurethane binder as claimed for the invention, which also serves as adhesive for bonding with the surface of the structure. It is preferable to produce a large-area reinforcement such as this in situ by layering.

The portion of a building element comprises a flanged or laminar first sectional area Q1 and a second sectional area Q2 projecting downward and subjected to tensile stresses. The surface of the second sectional area Q2, that is, outside the underlying surface section, primarily the side surfaces positioned at an angle to the surface of the first sectional portion, are used in conjunction with a fiber reinforcement FA transferring tensile stresses and characterized by high strength and high elasticity modulus, such as a reinforcement with carbon fibers and an epoxy binder. While it is true that this fiber reinforcement may in theory also be produced in situ, the high strength and elasticity modulus values required in this case nevertheless frequently call for prefabrication on special machines. For this purpose a reinforcement such as this, as illustrated in the drawing, consists of individual flat sections which occasion no shaping problems from the viewpoint of production technology. These sections of the reinforcement FA are bonded to the surface of the structure by adhesives of sufficiently high strength, in particular, as claimed for the invention, epoxy polymers which set under moisture.

On their exterior surfaces the sections of the reinforcement FA are used in conjunction with deformation-resistant elements transmitting shear stresses SUI and SU2 which represent two different versions of shear stress transmission from the tensile stress area to the compressive strain area. The element SU1 is essentially in the form of a thick-walled, elongated laminar element to which to which an anchor bolt BA extending into the first sectional portion Q1, and optionally even extending through it, is welded. This bolt may even be provided at the top of the sectional portion with a bolted joint for the purpose of pretensioning. It is claimed for the invention that the necessary shear-resistant bonding of element SU1 to the exterior of the reinforcement FA section facing it is effected also by means of a moisture-setting epoxy adhesive (not shown in the illustration). The latter statement also applies to the vertical profile side of element SU2, which is in the form of a thick-walled angle section. Bonding to sectional area Q2 is again effected by means of a bolted joint (here indicated only schematically as a center line). Such designs allow striking optimization in the heavy load application area.

What is claimed is:

1. A reinforcement for surfaces of structural elements or buildings comprising:

at least one base layer; and an adhesive layer for bonding the at least one base layer to the surfaces of the structural elements of buildings, which, following a curing process, is vapor permeable, has a high tensile strength and has a high tensile modulus of elasticity.

2. A reinforcement as described in claim 1 wherein the adhesive layer is based upon a polyurethane that is water vapor permeable when in a cured state.

3. A reinforcement as described in claim 1 wherein the base layer has a fiber support assembly comprising a fiber cluster or plaited fibers with a binder, sections of which form the adhesive layer, and the cured adhesive layer is permeable by water vapor.

4. A reinforcement as described in one of the preceding claims wherein the cured adhesive layer has a water permeation resistance $uH_2O$ of a maximum of approximately 350 mol.

5. A reinforcement as described in one of claims 1–3 wherein the cured adhesive layer has a water permeation resistance $uH_2O$ ranging from approximately 500 to approximately 3000 $m^{-1}$.

6. A reinforcement as described in one of claims 1–3 wherein the adhesive layer has a tensile modulus of elasticity of a minimum of approximately 1000 $N/mm^2$.

7. A reinforcement as described in claim 6 wherein the adhesive layer has a tensile modulus of elasticity ranging from approximately 3000 $N/mm^2$ to approximately 6000 $N/mm^2$.

8. A reinforcement as described in claim 3 wherein fiber support assembly consists of fibers selected from the group consisting of alkali-resistant E glass, AR glass, carbon, boron and high strength aramide polymer fibers.

9. A reinforcement as described in one of claims 1–3, wherein there is mounted inside the vapor-permeable adhesive bonding between the surfaces and the base layer at least one second adhesive layer transmitting tensile or shear stress, having a plurality of adhesive layer sections, with material of high strength and of high modulus of elasticity but of low vapor permeability.

10. A reinforcement as described in claim 9 wherein the at least one second adhesive layer section is mounted in an end area of a beam-like structural element or building element.

11. A reinforcement as described in claim 9 wherein the at least one second adhesive layer section extends on at least one longitudinal surface of a beam-like structural component or building element in the lengthwise direction of the beam or column.

12. A reinforcement as described in claim 11, wherein the at least one second adhesive layer section occupies only a part of the width of the pertinent longitudinal area of a beam-shaped or columnar structural element or a building element.

13. A reinforcement as described in claim 9, wherein a plurality of second adhesive layer sections of which sections extend from one edge to an opposite edge of the surfaces of structural elements or buildings.

14. A reinforcement as described in claim 9 wherein the structural elements or building elements are in the form of wall projections and the at least one second adhesive layer section overlaps the reentrant between projection and adjacent wall surface.

15. A reinforcement as described in claim 9 wherein the at least one second adhesive layer sections has at least one high-strength polymer adhesive, in particular an epoxy or acrylate adhesive.

16. A reinforcement as described in claim 1 wherein the at least one base layer is a prefabricated flat material fiber element of laminated material.

17. A reinforcement as described in claim 1 or claim 2, wherein the at least one base layer is a prefabricated flat laminated fiber material element of high strength and of high modulus of elasticity but of low vapor permeability bonded to at least one adhesive layer which is water vapor permeable in some sections.

18. A reinforcement assembly for surfaces of structural elements or building elements having at least one reinforcement, each reinforcement comprising:

at least one base layer; and an adhesive layer for bonding the at least one base layer to the surfaces of the structural elements of buildings and is integrated with the structural element or building and the interior of a fiber assembly of the base layer, wherein said adhesive layer is a polyurethane material and, following a curing process, is water vapor permeable, has a high tensile strength and has a high tensile modulus of elasticity as measured in the direction perpendicular to the base of a minimum of approximately 6000 $N/nm^2$.

19. A reinforcement assembly as described in claim 18, wherein the cured adhesive layer has a tensile modulus of elasticity as measured in the direction perpendicular to the base ranging from approximately 8000 $N/nm^2$ to approximately 10,000 $N/nm^2$.

20. A reinforcement assembly as described in claim 18 or 19 wherein the cured adhesive layer has a tensile separating stress as measured in the direction perpendicular to the base of a minimum of approximately 2.5 $N/nm^2$.

21. A reinforcement assembly as described in claim 20 wherein the cured adhesive layer has a tensile separating stress as measured in the direction perpendicular to the base ranging from approximately 3 $N/nm^2$ to approximately 8 $N/nm^2$.

22. A reinforcement assembly as described in one of claim 18 or 19 wherein the surfaces of the structural component or building have at least one reinforcement of a first type in the form of a vapor-permeable composite laminated fiber layer produced in situ and at least one reinforcement of a second type in the form of a bonded composite fiber layer of high strength and high modulus of elasticity but of low vapor permeability.

23. A reinforcement assembly as described in claim 22 wherein the reinforcement of the first type has a vapor-permeable polyurethane-based binder material and the reinforcement of the second type has an adhesive layer and optionally also has an epoxy-based binder material.

24. A reinforcement assembly as described in claim 22, wherein the reinforcements of the first and second types are installed in adjacent areas of the surfaces of the structural elements or building elements.

25. A reinforcement assembly as described in claim 22 wherein at least two reinforcements of the first type and second type are installed so as to overlap when bonded to the surface of the structural elements or building elements.

26. A reinforcement assembly as described in claim 25 wherein the reinforcement of the second type is positioned on top of the reinforcement of the first type when bonded to the surface of the structural element or building element.

27. A reinforcement assembly as described in claim 18 or 19 wherein at least one reinforcement has an adhesive curing under moisture and is an epoxy-based binder material.

28. A reinforcement assembly as described in claim 18 or 19 further comprising at least one first flanged or plate-shaped cross-sectional area subjected to compressive stresses and at least one second stud-like second cross-sectional element subjected to tensile stresses wherein:

the lateral surfaces of the second cross-sectional element is installed at an angle to the surface of the first cross-sectional element and is integrated with at least one reinforcement transmitting tensile stresses; and the fiber reinforcement integrated with the second cross-sectional element is further integrated by adhesive bonding with at least one deformation-resistant shear stress transmission element which is integrated with the first cross-sectional element to transfer force.

29. A reinforcement assembly as described in claim 28 wherein the at least one bending-resistant shear stress transmission element engages the tensile stress area of the first cross-sectional element and is integrated with it by positive locking or material closure.

30. A reinforcement assembly as described in claim 28 wherein the at least one shear stress transmission element is a composite-material fiber reinforcement.

31. A reinforcement as described in one of claims 1 and 2 wherein the adhesive layer is a polyurethane-based material which in its cured state possesses a water vapor permeation resistance $uH_2O$ of a maximum of approximately 350 $m^{-1}$ and a tensile elasticity modulus of a minimum of approximately 1000 $N/mm^2$.

32. A reinforcement as described in claim 31 wherein the adhesive layer is a polyurethane-based material which in its cured state possesses a water vapor permeation resistance $uH_2O$ ranging from approximately 350 $m^{-1}$ to approximately 3000 $m^{-1}$ and a tensile elasticity modulus ranging from approximately 3000 $N/mm^2$ to approximately 6000 $N/mm^2$.

33. A reinforcement as described in claim 1 or 2 or 3 or 16 wherein at least one material component is water-vapor permeable product of reaction of low-molecular polyols which possess rigid chains of molecules which are at least partly linear, with aromatic or heterocyclic polyisocyanates.

34. A reinforcement assembly as described in claim 18 or 19 wherein at least one material component is water-vapor permeable product of reaction of low-molecular polyols which possess rigid chains of molecules which are at least partly linear, with aromatic or heterocyclic polyisocyanates.

35. A reinforcement as described in claim 1 further comprising a base primer.

36. A reinforcement as described in claim 1 further comprising a cover layer.

* * * * *

UNITED STATES PATENT AND TRADEMARK OFFICE

CERTIFICATE OF CORRECTION

PATENT NO. : 6,457,289 B1
DATED : October 1, 2002
INVENTOR(S) : Josef Scherer

It is certified that error appears in the above-identified patent and that said Letters Patent is hereby corrected as shown below:

Column 2,
Line 22, delete "N/nm2" and insert -- $N/mm^2$ --
Line 23, delete "$N/nm^2$" and insert -- $N/mm^2$ --
Line 23, delete "$N.nm^2$" and insert -- $N/mm^2$ --

Column 7,
Line 3, delete "$N/nm^2$" and insert -- $N/mm^2$ --
Line 7, delete "$N/nm^2$" and insert -- $N/mm^2$ --
Line 8, delete "$N/nm^2$" and insert -- $N/mm^2$ --
Line 16, delete "$N/nm^2$" and insert -- $N/mm^2$ --
Line 17, delete "$N/nm^2$" and insert -- $N/mm^2$ --

Signed and Sealed this

Twenty-fifth Day of February, 2003

JAMES E. ROGAN
*Director of the United States Patent and Trademark Office*